US006704643B1

(12) United States Patent
Suhre et al.

(10) Patent No.: US 6,704,643 B1
(45) Date of Patent: Mar. 9, 2004

(54) ADAPTIVE CALIBRATION STRATEGY FOR A MANUALLY CONTROLLED THROTTLE SYSTEM

(75) Inventors: Blake R. Suhre, Neenah, WI (US); Robert E. Haddad, Oshkosh, WI (US); Jeffery C. Ehlers, Neenah, WI (US); Steven J. Gonring, Slinger, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 10/245,434

(22) Filed: Sep. 16, 2002

(51) Int. Cl.[7] ..... F02D 41/04; F02D 11/10
(52) U.S. Cl. ..... 701/115; 701/103; 123/399
(58) Field of Search ..... 701/115, 103, 701/102, 114; 123/396, 361, 399, 400; 73/1.88, 1.75

(56) References Cited

U.S. PATENT DOCUMENTS 5,157,956 A * 10/1992 Isaji et al. ..... 73/1.75
5,381,769 A 1/1995 Nishigaki et al. ..... 123/399
5,664,542 A 9/1997 Kanazawa et al. ..... 123/361
5,899,191 A * 5/1999 Rabbit et al. ..... 701/114
6,026,783 A * 2/2000 Nestvall et al. ..... 123/399
6,095,488 A 8/2000 Semeyn, Jr. et al. ..... 251/129
6,273,771 B1 8/2001 Buckley et al. ..... 440/84
6,351,704 B1 * 2/2002 Koerner ..... 701/115
6,379,114 B1 * 4/2002 Schott et al. ..... 416/1
6,414,607 B1 7/2002 Gonring et al. ..... 341/20

* cited by examiner

*Primary Examiner*—Hieu T. Vo
(74) *Attorney, Agent, or Firm*—William D. Lanyi

(57) ABSTRACT

A calibration procedure involves the steps of manually placing a throttle handle in five preselected positions that correspond with mechanical detents of the throttle control mechanism. At each of the five positions, one or more position indicating signals are received by a microprocessor of a controller and stored for future use. The five positions comprise wide open throttle in forward gear, wide open throttle in reverse gear, the shift position between neutral and forward gear, the shift position between neutral and reverse gear, and the mid-point of the neutral gear selection range. The present invention then continuously monitors signals provided by a sensor of the throttle control mechanism and mathematically determines the precise position of the throttle handle as a function of the stored position indicating signals. In one embodiment, each position indicating signal comprises three redundant signal magnitudes.

20 Claims, 6 Drawing Sheets

ADAPTIVE CALIBRATION STRATEGY FOR A MANUALLY CONTROLLED THROTTLE SYSTEM

BACKGROUND OF THE INVENTION

1. Field of the Invention

The present invention is generally related to a manually controlled throttle system and, more particularly, to a calibration strategy that minimizes potential errors that could otherwise result from the buildup of manufacturing and assembly tolerances within the throttle control system.

2. Description of the Prior Art

Manually controlled throttle systems, used in conjunction with marine vessels, are well known to those skilled in the art. In many different types of pleasure craft, the operator of the marine vessel is provided with a manually movable hand lever or levers which can be used by the operator to select both engine speed and gear choice. With regard to engine speed, the operator is typically provided with a choice from idle speed to wide open throttle (WOT). With regard to gear selection, the operator is typically provided with choices of forward, neutral, or reverse gear positions. In drive-by-wire systems, the position of the manually operated handle, or lever, is sensed by an appropriate sensor, such as a potentiometer, and a signal is provided to a microprocessor. That signal is representative of the position of the manually movable throttle handle. The microprocessor then interprets the desired engine speed from the received signal and controls the actual throttle and/or fuel injectors of the engine to obtain the desired speed as requested by the operator of the marine vessel.

U.S. Pat. No. 6,414,607, which issued to Gonring et al on Jul. 2, 2002, discloses a throttle position sensor with improved redundancy and high resolution. A throttle position sensor is provided with a plurality of sensing elements which allow the throttle position sensor to provide a high resolution output to measure the physical position of a manually movable member, such as a throttle handle, more accurately than would otherwise be possible. The plurality of sensors significantly increases the redundancy of the sensor and allows its operation even if one of the sensing elements is disabled.

U.S. Pat. No. 6,273,771, which issued to Buckley et al on Aug. 14, 2001, discloses a control system for a marine vessel. The control system incorporates a marine propulsion system that can be attached to a marine vessel and connected in signal communication with a serial communication bus and a controller. A plurality of input devices and output devices are also connected in signal communication with the bus and a bus access manager, such as a CAN Kingdom network, is connected in signal communication with the controller to regulate the incorporation of additional devices to the plurality of devices in signal communication with the bus, whereby the controller is connected in signal communication with each of the plurality of devices on the communication bus. The input and output devices can each transmit messages to the serial communication bus for receipt by other devices.

U.S. Pat. No. 5,664,542, which issued to Kanazawa et al on Sep. 9, 1997, describes an electronic throttle system. On one side of a valve shaft, there are provided an accelerator drum connected to an accelerator pedal by an accelerator wire, a return spring for urging the accelerator drum in a valve closing direction, and an accelerator sensor for detecting rotation of the accelerator drum and transmitting a detected signal to a host system. On the other side of the valve shaft, there are provided a large-diameter gear and an opening sensor. An armature of a solenoid clutch is attached to the gear and held on a motor shaft via a slide bearing. Thus, the motor, the solenoid clutch, and the throttle valve are arranged in a U-shape form for interconnection through four gears.

U.S. Pat. No. 6,095,488, which issued to Semeyn, Jr. et al on Aug. 1, 2000, describes an electronic throttle control with adjustable default mechanism. The system has a housing with a motor, throttle valve, gear mechanism, and fail-safe mechanism. A spring member attached to a gear member and default lever, and which is biased when the throttle valve is in its fully open and closed positions, operates to open the throttle valve in the event of an electric failure, thus allowing the vehicle to limp home. An adjustable pin member is used to adjust the position of the default lever and thus the throttle valve in a fail-safe situation.

U.S. Pat. No. 5,381,769, which issued to Nishigaki et al on Jan. 17, 1995, describes a throttle valve drive apparatus. It comprises an actuator which serves to mechanically drive a throttle valve disposed in an intake passage of an internal combustion engine and is controlled in accordance with an instruction from a control unit, an accelerator lever which serves to mechanically drive the throttle valve and to adjust the opening degree of the throttle valve in accordance with an amount of operation performed by an operator. A first clutch disposed between rotary shafts of the actuator and the throttle valve and serving to transmit a turning force from the actuator to the throttle valve, and a second clutch disposed between rotary shafts of the accelerator lever and the throttle valve and serving to transmit the turning force from the accelerator lever to the throttle valve. An engaging force of the first clutch is discriminated from that of the second clutch, one of the first and second clutches having a greater engaging force comprising an on-off constant engagement type clutch, the other clutch having a smaller engaging force comprising a constant engagement type clutch, and the on-off type clutch is switched on and off so as to transmit the turning force to the throttle valve selectively from the actuator or the accelerator lever.

The patents described above are hereby expressly incorporated by reference in the description of the present invention.

Unlike known throttle control systems for marine vessels, in which push-pull cables connect a manually movable lever to the actual throttle control linkage system of the marine propulsion device, drive-by-wire throttle control systems provide electrical signals between a manually controllable throttle lever mechanism and an engine control unit of the marine propulsion device. A sensor is provided to detect the physical position of the manually movable handle and the sensor provides electrical signals, on the signal wires, to the engine control unit (ECU) associated with the one or more engines of a marine propulsion system. This type of system requires that the sensor be sufficiently accurate to measure and provide appropriate signals representing the physical position of the manual movable handle. Because of the potential buildup of tolerances during the manufacture of the manually controllable lever and associated equipment, the signal provided by the position sensor may not be completely reliable with regard to the precise position of the handle.

It would therefore be significantly beneficial if a system could be provided that accurately and efficiently allows the calibration of a drive-by-wire throttle control system.

SUMMARY OF THE INVENTION

A method for operating a throttle control system, in accordance with the preferred embodiment of the present invention, comprises the steps of providing a manually operated throttle controller, providing a sensor connected to the manually operated throttle controller and having an output which is representative of the position of the manually operated throttle controller, and providing a microprocessor connected in signal communication with the sensor and having an input connected in signal communication with the output. The present invention further comprises the steps of receiving a first position indicating signal from the sensor which is representative of a first known position of the manually operated throttle controller and receiving a second position indicating signal from the sensor which is representative of a second known position of the manually operated throttle controller.

In its most basic application, the present invention reads the first and second position indicating signals and stores those indicating signals for later use during the operation of a marine vessel. After the calibration is complete, the method for operating the throttle control system of the present invention further comprises the steps of receiving a subsequent position indicating signal from the sensor which is representative of a subsequent position of the manually operated throttle controller and then calculating the subsequent position of the manually operated throttle controller as a function of the subsequent position indicating signal and the first and second position indicating signals.

As will be described in greater detail below, each of the position indicating signals received by the microprocessor actually comprise three distinct magnitudes of three signals. The three signals are intended to be generally redundant to each other and are provided for purposes of accuracy and redundancy in the event that one or more of the three signals are unavailable to the system.

In a particularly preferred embodiment of the present invention, the method comprises the steps of receiving first, second, third, fourth, and fifth position indicating signals from the sensor which are representative, respectively, of first, second, third, fourth, and fifth known positions of the manually operated throttle controller, or lever handle. The receipt and storage of five position indicating signals allows the present invention to determine whether the throttle handle is in a neutral position range, whether the throttle handle is in a forward gear selection position or reverse gear selection position, and also allows the present invention to determine the percentage of wide open throttle engine speed that is being currently requested by the operator of the marine vessel. In the particularly preferred embodiment of the present invention, the first and fifth known positions correspond to reverse and forward maximum throttle positions. The second and fourth known positions correspond to the reverse and forward shift detent positions that signify the transition location between the neutral gear position and both reverse and forward gear positions. The fifth known position is a detent location that is generally in the center portion of the neutral gear selection range.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
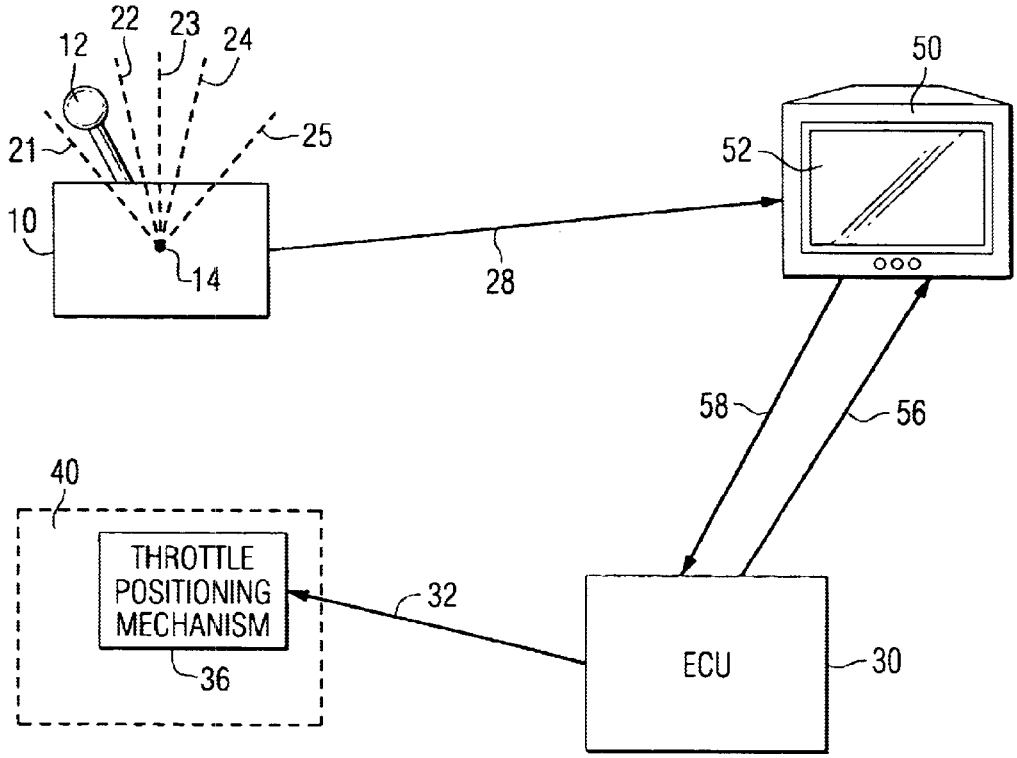
FIG. 1 is a simplified representation of some of the components used in association with the present invention.

Throughout the description of the preferred embodiment of the present invention, like components will be identified by like reference numerals.

The present invention will be described in terms of a throttle control system that incorporates a throttle position sensor generally similar to the sensor disclosed in U.S. Pat. No. 6,414,607 which is described above. That particular throttle position sensor provides three signals, each of which represents a position of a throttle handle. The three signals are intended to be generally redundant with respect to each other, but are used cooperatively to determine the position of the throttle handle with respect to forward, neutral, or reverse gear selection positions and, in addition, with respect to the relative position of the handle with regard to a percentage of wide open throttle engine speed that is being requested by the operator.

It should be understood that the method of the present invention does not require the use of the throttle position sensor disclosed in U.S. Pat. No. 6,414,607. Alternatively, it can be used in conjunction with a throttle position sensor that only provides a single signal. However, for purposes of the description of the preferred embodiment of the present invention below, a three-potentiometer system such as that described in U.S. Pat. No. 6,414,607, will be used.

FIG. 1 is a highly schematic representation of a throttle control system of a marine vessel incorporating a manually operated throttle control device 10 which incorporates a manually movable handle 12, or lever. The manually movable handle 12 is rotatable about a pivot 14 to allow the operator of a marine vessel to select an engine speed and a gear position. In FIG. 1, five dashed lines are shown to represent five possible positions of the throttle handle 12. For example, dashed line 21 can represent a position of the throttle handle 12 that represents a command, by the operator of the marine vessel, for a wide open throttle (WOT) engine speed in combination with a forward gear selection. Position 22 represents a forward gear selection at approximately idle engine speed which can be, for example, about 20% of WOT. Position 23 is at a location which is near a midpoint of a neutral gear selection range. Position 24 is the location at which the throttle control system switches from neutral gear position to reverse gear position at approximately idle engine speed. Position 25 is a demand for wide open throttle engine speed in reverse gear. The range between positions 22 and 24 represent a neutral gear range. The range between positions 21 and 22 represent the forward gear selection range and the range between positions 24 and 25 represent a reverse gear selection range.

Typically, a potentiometer or similar device is provided in the throttle selection apparatus 10 to provide a signal, on line 28, to microprocessor controlled device, such as the monitor 50. The microprocessor of the helm control unit 30, as will be described in greater detail below, determines the actual engine speed demand, as represented by the throttle handle 12, and provides appropriate signals, on line 32, to the throttle mechanism 36 which can include a control motor for manipulating the position of a throttle plate and/or a control unit for determining the appropriate operation of a plurality of fuel injectors to achieve the engine speed demanded by the position of the throttle handle 12. The result of the action of the throttle mechanism 36, under control of the helm control unit 30, is that the operating speed of the engine 40 is maintained at the magnitude requested by the operator of the marine vessel.

With continued reference to FIG. 1, the display monitor 50 can be provided with a screen 52 on which information can be displayed to the operator of, the marine vessel or, during calibration procedures, to a person (e.g. a boat builder) who is installing the marine propulsion system in the marine vessel. In other words, a boat builder would likely be the initial person who utilizes the calibration procedures of the present invention.

Requests are provided by the helm control unit 30 and transmitted to the monitor 50, on line 56, with instructions to be followed by the person calibrating the system. At least one switch, such as a push button, is provided to allow the person calibrating the system to communicate with the helm control unit 30, on line 58. Lines 56 and 58 in FIG. 1 functionally represent the directions of information exchange. It should be understood, however, that the exchange of information is physically made on a CAN bus in a preferred embodiment of the present invention. A system which utilizes a CAN bus in conjunction with a marine vessel is disclosed in U.S. Pat. No. 6,273,771 which is described above. The procedures used during the calibration process of the present invention will be described in greater detail below, but it essentially comprises a step-by-step process during which the helm control unit 30 communicates requests to the person calibrating the system, that person performs the requested action, and then a push button is actuated to inform the helm control unit 30 that the action has been completed. A series of actions are performed by the person doing the calibrating of the system and a series of signals are received by the helm control unit 30 in order to properly calibrate the positions of the throttle handle 12 with respect to the signals provided by the sensor on line 28. This allows the helm control unit 30 to determine the accurate meaning of the signals received on line 28 when the operator of the marine vessel is using the vessel. In a preferred embodiment of the present invention, the monitor 50 is provided with a microprocessor to control the displays and to perform certain mathematical computations. It should also be understood that most of the individual components and devices are connected directly to the CAN bus and this arrangement eliminates the need for them to be hard wired to each other although they communicate information to each other.

It should be understood that one potential problem of a throttle control system 10, such as that described above, is that the position of the sensor within the throttle control system 10 may not be precisely associated with the physical positions in which the throttle control handle can be placed. In other words, when the throttle handle 12 is moved to its maximum wide open throttle position, in forward gear, the sensor position may be such that it does not provide a maximum possible signal on line 28 to the helm control unit 30. Similarly, when the throttle handle 12 is moved to its maximum wide open throttle position in reverse gear, the magnitude of the signal provided by the sensor may not be in its maximum position. Mechanical tolerances associated with the throttle control system 10 may cause the signal magnitudes associated with positions 21–25 to be other than would normally be expected if all of the components of the throttle control mechanism 10 were perfectly and precisely assembled.

Figure 2:
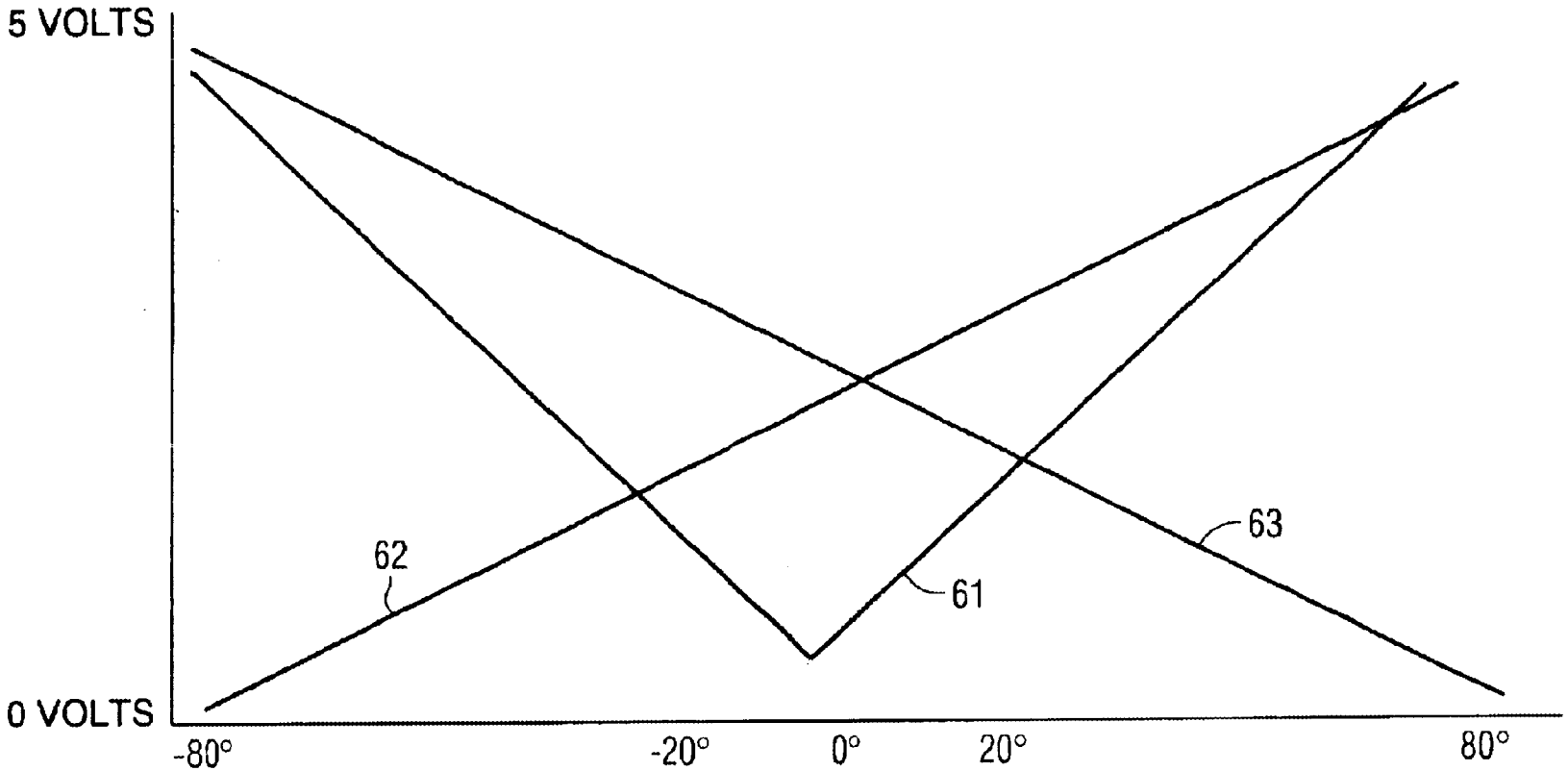
FIG. 2 is a graphical representation of the various signals provided by a throttle control device.

FIG. 2 is a graphical representation which shows the variable signals provided by three potentiometers associated with a throttle position sensor as a function of actual handle position. For purposes of reference, the graphical representation in FIG. 2 is generally of the type that would result from the use of a throttle position sensor similar to that disclosed in U.S. Pat. No. 6,414,607, but without a pronounced dead band in the central region of the first signal 61 as discussed in that patent. In FIG. 2, the first signal 61 is a generally V-shaped signal that represents the output magnitudes from a sensor of the throttle control system 10 which represent positions of the throttle handle 12 from a full wide open throttle position in reverse gear, at −80°, to a full wide open throttle position in forward gear at +80°. A second signal 62 and a third signal 63 are provided by two other potentiometers associated with the sensor in a throttle control system 10 similar to that described in U.S. Pat. No. 6,414,607. Because of normal assembly tolerances, the minimum signal magnitude of the first signal 61 may not coincide precisely with the zero degrees rotation position of the throttle handle 12, as represented by position 23 in FIG. 1. Similarly, the second and third signals, 62 and 63, may not cross at precisely the center position 23. These misalignments are exaggerated in the Figures for purposes of illustration.

Figure 3:
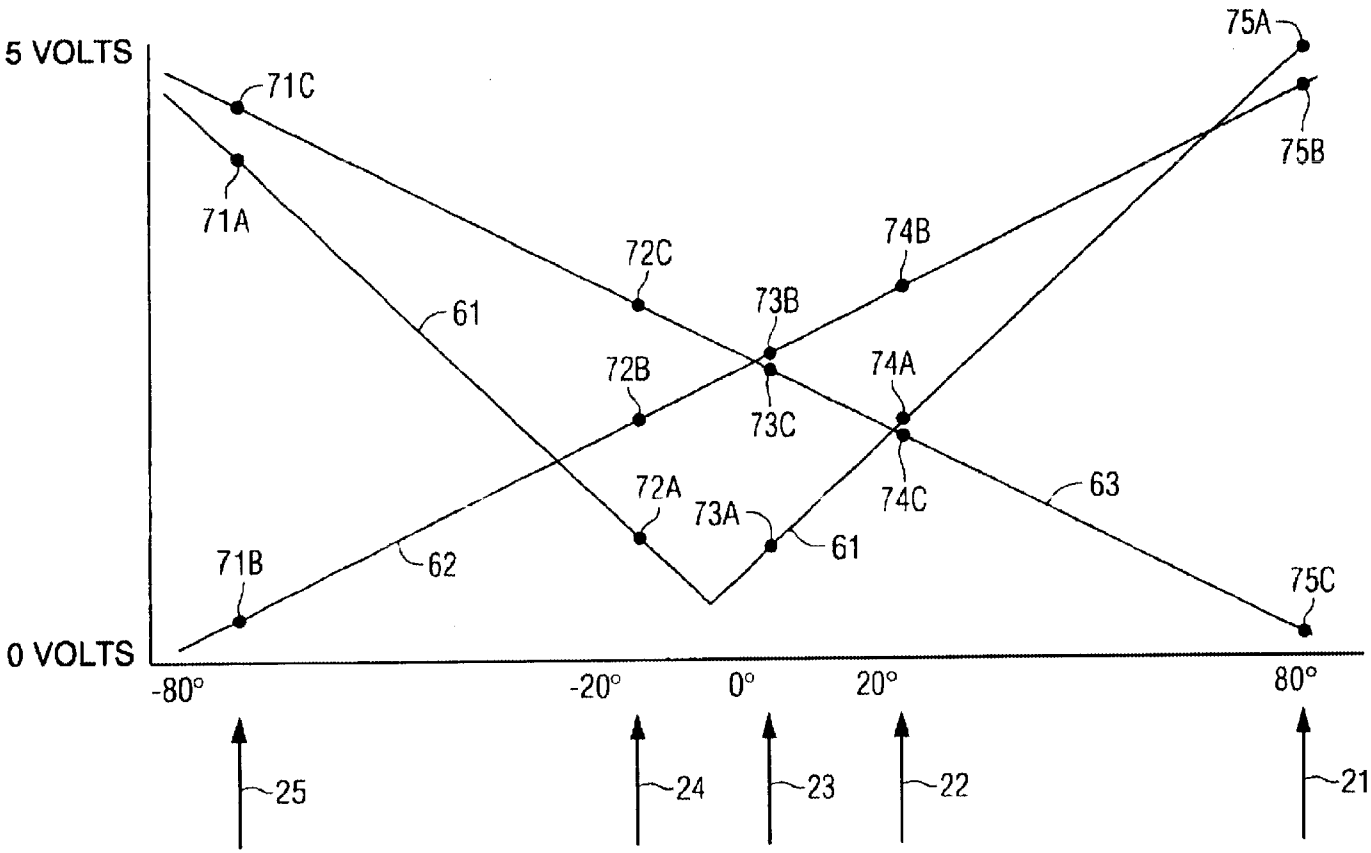
FIG. 3 is a graphical representation of various signal magnitudes used by the present invention.

With reference to FIG. 3, the calibration process of the present invention first requests that the person doing the calibrating procedure place the throttle handle 12 in position 25 and, more specifically, in a position at which a mechanical detent is provided so that the person calibrating the system can select position 25 with greater assurance. When the calibrator responds, by actuating a push button, that the throttle handle 12 is in position 25, the microprocessor of the helm control unit 30 receives a first position indicating signal. Since three potentiometers are used by the sensor of the throttle control device 10, three signal magnitudes are received by the helm control unit 30. These three values are identified by reference numerals 71A, 71B, and 71C, for the first, second, and third signals from the three potentiometers described above. The person calibrating the system is then requested to move the throttle position handle 12 to position 24. When this action is acknowledged by push buttons, the microprocessor of the helm control unit 30 receives signals 72A, 72B, and 72C. This procedure is repeated for positions 23, 22, and 21. When completed, the microprocessor of the helm control unit 30 has received and stored 15 signal values, as represented in FIG. 3, with three signal values being associated with each of the five positions, 21–25. Signal magnitudes 71A-75A being associated with the first signal 61, signal magnitudes 71 B-75B being associated with the second signal 62, and signal magnitudes 71C–75C being associated with the third signal 63.

Figure 4:
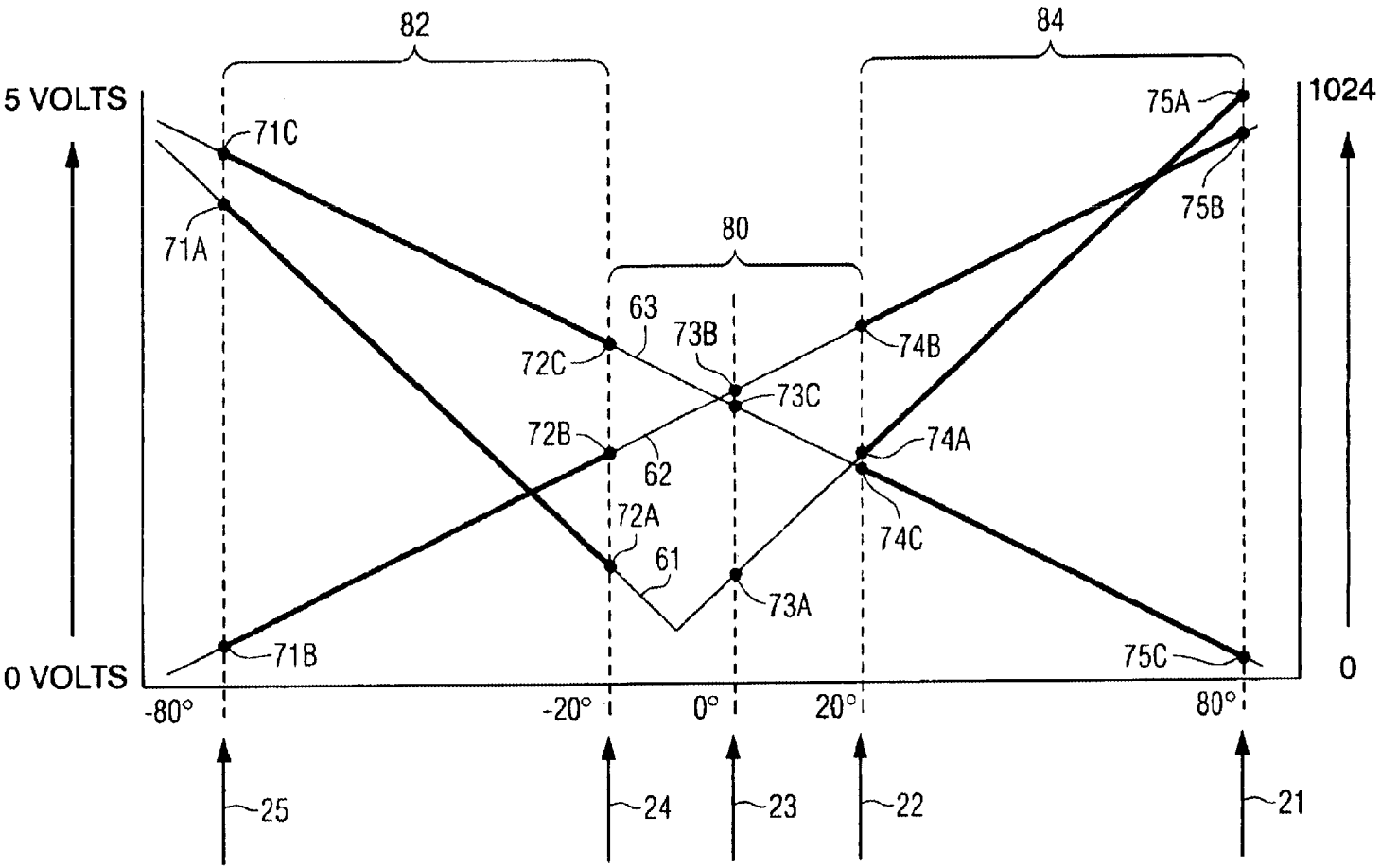
FIG. 4 is similar to FIG. 3, but with certain signal ranges accentuated for purposes of the exemplary discussion.

FIG. 4 is generally similar to FIG. 3, but with certain portions of the first, second, and third signals, 61–63, darkened to represent certain ranges of the signal magnitudes that will be discussed. Also, dashed vertical lines are provided in FIG. 4 to connect associated magnitudes of the three signals at each of the five positions. For purposes of the description of the preferred embodiment of the present invention, the range of travel of the throttle handle 12 will be divided into three ranges. A central range 80 represents the range of travel of the throttle handle 12 between positions 22 and 24. This range corresponds to a neutral gear position selection between the associated detent locations at positions 22 and 24. The reverse gear range 82 includes all of the engine speed selection positions between idle speed, at position 24, and wide open throttle (WOT) in reverse gear at position 25. Range 84 represents the range of forward engine speeds between positions 22 and 21. At position 22, the gear selection transitions from neutral gear to forward gear and the engine speed increases as the throttle handle 12 is moved from position 22 to position 21.

Also shown in FIG. 4 is an additional vertical axis that provides the digital value of the signal provided by the sensor of the throttle control mechanism 10 to the helm control unit 30. These digital signals can be provided by an 10-bit analog-to-digital converter associated with the zero to 5 volt signal represented on the left vertical axis in FIG. 4.

Figure 5:
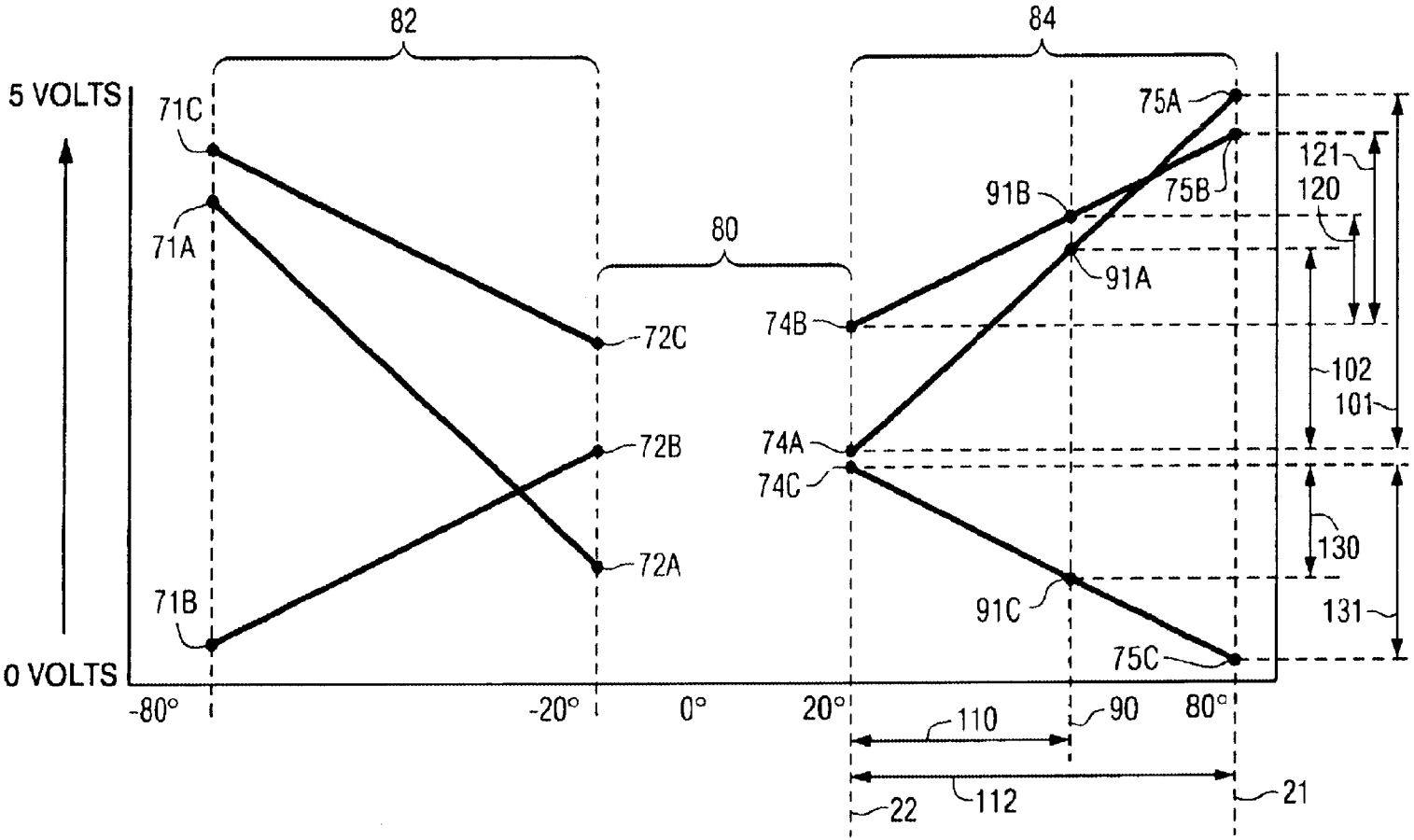
FIG. 5 is generally similar to FIG. 4, but with additional information provided to facilitate a description of the mathematical calculation performed by the present invention.

FIG. 5 is generally similar to FIG. 4, but with only selected portions of the first, second, and third signals being shown. The portions of these signals that are located in the neutral range 80 have been removed in order to simplify the illustration for the purpose of describing how the information described above in conjunction with FIG. 4 is used to determine a precise position of the throttle handle 12 when the operator of the marine vessel selects a subsequent throttle position in forward gear after the calibration process has been completed.

The following description of the use of the present invention will relate to its use after the calibration procedure has been completed. More particularly, the sensor magnitudes identified by reference numerals 74A–74C and 75A–75C are known by the microprocessor of the helm control unit 30 and have been stored during the most recent calibration procedure. It should also be understood that the magnitudes identified by reference numerals 71A–71C and 72A–72C are also known by the helm control unit 30, but do not directly relate to the example that will be discussed below.

With reference to FIGS. 1 and 5, the microprocessor of the helm control unit 30 continuously monitors the signals received on line 28 from the sensor of the throttle control device 10 which represent the current position of the throttle handle 12. The signals received on line 28 by the helm control unit 30 typically comprise the three magnitudes associated with the first, second, and third signals, 61–63, described above. For purposes of this example, the three signals received on line 28 are associated with dashed line 90 in FIG. 5 and are identified by reference numerals 91A–91C. As can be recognized by one skilled in the art, the absolute value of the signal magnitude 91A is not, by itself, sufficiently informative to determine whether or not the throttle handle 12 is in a forward gear position or a reverse gear position. This results from the fact that the first signal 61 is V-shaped and the value of signal magnitude 91A could possible be associated with either side of the V-shaped signal. However, the second and third signals, 62 and 63, allow the helm control unit 30 to determine that the throttle handle 12 is in the forward gear range 84. With this known, the precise position of the throttle handle 12, as represented by dashed line 90 in FIG. 5, can be calculated.

With continued reference to FIG. 5, and more particularly to signal magnitude 91A, its position can be calculated with respect to the stored position indicating signal magnitudes 74A and 75A. First, the total signal range between these two stored points can be calculated and is represented by arrow 101 in FIG. 5. The difference between signal magnitudes 91 and 74A can also be easily determined mathematically and is represented by arrow 102. The ratio of the magnitudes represented by arrows 102 and 101 is equivalent to the ratio between arrows 110 and 112 which are associated with the actual angular travel of the throttle handle 12, as represented by degrees of rotation of the throttle handle about point 14 in FIG. 1.

In some systems, the use of a single sensor signal could suffice. However, for purposes of redundancy, the present invention utilizes three potentiometers.

A similar calculation can be made with respect to magnitudes 74B, 91B, and 75B. The appropriate subtractions can be made and the magnitudes represented by arrows 120 and 121 can be compared to determine their ratio. The resulting ratio is equivalent to the ratio of arrows 110 and 112. Similarly, signal magnitudes represented by reference numerals 74C, 91C, and 75C can be compared to determine the ratio of arrows 130 and 131 which, when compared, result in a ratio that is equivalent to the ratio of arrows 110 and 112. All three of the above described calculations should result in the ratio of arrows 10 to 112. These three calculations provide a degree of redundancy and error checking that can detect faults that may occur in the mechanical and electrical system. If any one signal significantly differs from the others, it can be ignored and an alarm message can inform the vessel operator.

With continued reference to FIG. 5, the above described example related to a throttle handle position 90 in the forward gear selection range 84. One skilled in the art will readily appreciate that the same calculation procedures could be used to determine the throttle handle position within the reverse gear selection range 82. For either of these two gear selection ranges, 82 or 84, the present invention uses three pairs of signal magnitudes which are stored by the microprocessor in comparison with three subsequent position indicating signals, 91A–91C, to mathematically determine the position of the throttle handle 12 relative to the range represented by the three pairs of stored signals.

In a particularly preferred embodiment, the current throttle handle position can be monitored as the operator moves the throttle handle 12 within the neutral gear selection range 80. This procedure is not required in all embodiments of the present invention, but can be useful in anticipating the movement of the throttle handle 12 from the neutral gear position 80 into either the forward or reverse ranges, 84 or 82. In a manner generally similar to the determination of the ratios of arrows 110 to 112, the microprocessor determines the position of the throttle handle with respect to stored position indicating signals 72A–72C, 74A–74C, and 73A–73C as illustrated in FIG. 4. Even though the gear selector would remain in neutral gear as the throttle handle 12 is moved between positions 22 and 24, the microprocessor could be programmed to anticipate an imminent movement of the throttle handle into either the forward gear range 84 or the reverse gear range 82. This anticipation could be used to assure that the engine speed begins to be increased immediately as the gear selector is moved from neutral to either forward or reverse gears.

Figure 6:
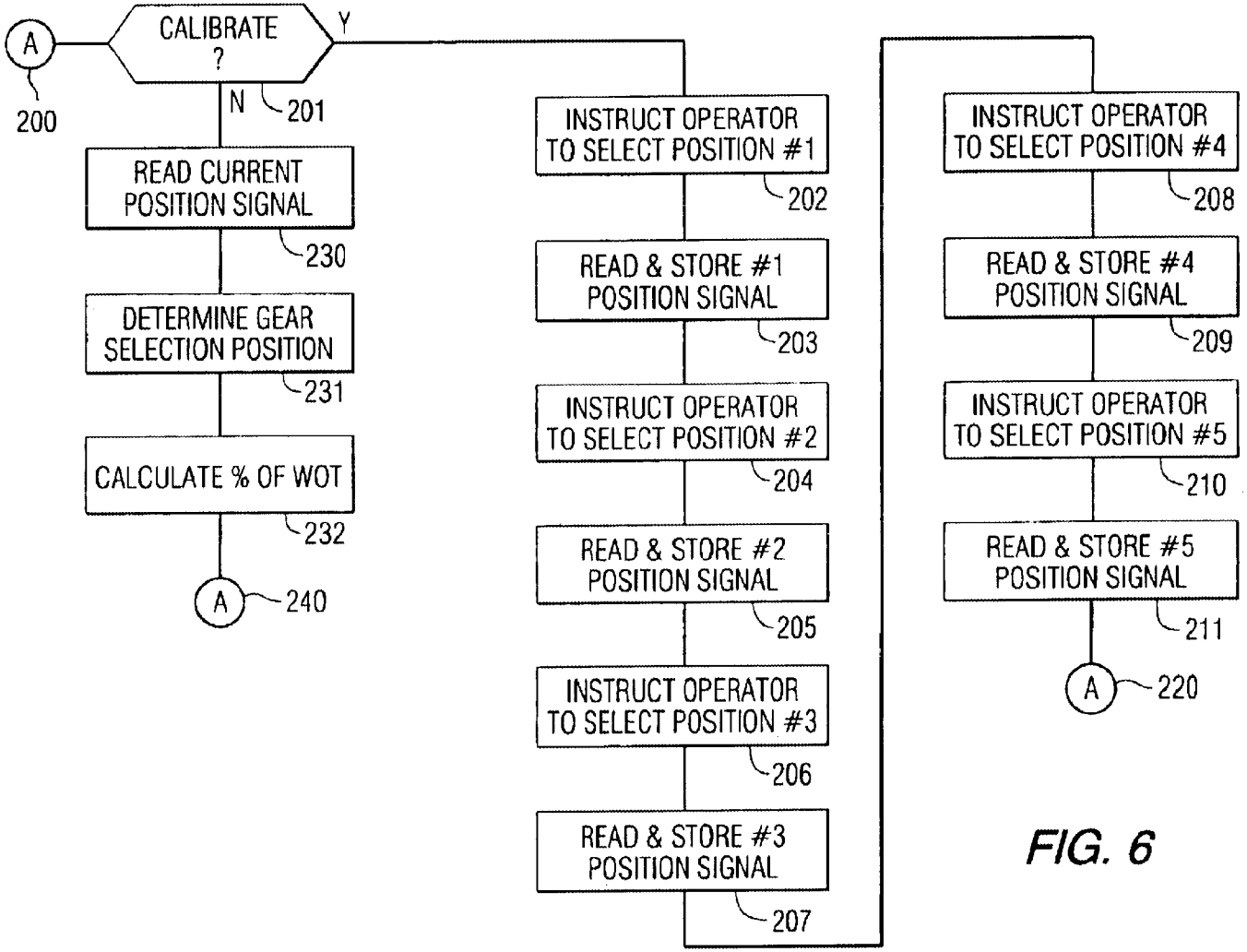
FIG. 6 is a simplified flow chart of the method of the present invention.

FIG. 6 is a simplified flow chart of the process of the present invention. From a starting point 200 the microprocessor of the helm control unit 30 determines whether or not a calibration procedure is requested. This is represented by functional block 201. If the procedure is requested, typically by a boat builder, the person performing the calibration procedure is instructed to place the throttle handle 12 in a first position, as represented by functional block 202. This could be position 21 in FIG. 1. Then the signal on line 28 is read and stored as represented by functional block 203.

Depending on how many positions of the throttle handle are required to achieve the desired calibration accuracy, this process is repeated for each throttle handle position. This is represented by functional blocks 204 and 205 for the second position, functional blocks 206 and 207 for the third throttle position, functional blocks 208 and 209 for the fourth throttle position, and functional blocks 210 and 211 for the fifth throttle position. The program then returns to the start position 200 as represented by reference numeral 220.

With continued reference to FIG. 6, if the calibration procedure is not requested, at functional block 201, the microprocessor of the helm control unit 30 reads the current position signal at functional block 230. This process involves the receipt, on line 28, of the three signal magnitudes which are representative of the current position of the throttle handle 12. In the example described above in conjunction with FIG. 5, these three signal magnitudes are identified by reference numerals 91A–91C and their throttle handle position is represented by dashed line 90. As represented by functional block 231 in FIG. 6, the present invention then determines the gear selection position by calculating the differences of the current throttle position signals with the stored signal magnitudes. These difference are represented by the vertical arrows on the right side of FIG. 5. The ratios provided by the comparison of these signal magnitudes allows the helm control unit 30 to determine the ratio of arrows 110 to 112. This, in turn, allows a precise determination of the position of the throttle handle 12. The calculation of the ratio between arrows 110 and 112, in FIG. 5, allows the microprocessor to calculate the percentage of wide open throttle represented by the position of throttle handle 12 as described in functional block 232 in FIG. 6. Then the microprocessor returns to the start position 200 as indicated by reference numeral 240 in FIG. 6.

As described above, the method of the present invention receives a plurality of position indicating signals that each represent known positions of the manually operated throttle controller which are determined during the calibration procedure. These positions indicating signals are stored for future reference. In a preferred embodiment, five position indicating signals are received and stored and are each representative of an associated known position of the throttle handle 12. Subsequently, after the calibration procedure is completed, a subsequent position indicating signal is received from the sensor of the throttle control system. The subsequent position indicating signal is representative of a subsequent position of the manually operated throttle controller. The method of the present invention then calculates the subsequent position of the throttle handle as a function of the subsequent position indicating signal and the previously received and stored position indicating signals. The present invention provides a simple, but accurate calibrating process that allows the throttle control system to accurately determine the throttle handle position regardless of the mechanical tolerances relating to the assembly of the throttle handle and its associated throttle control mechanism and sensor. It should be understood that other calculation methods, other than determining the ratios, are also within the scope of the present invention. This also includes predetermined look-up tables which are based on the magnitudes determined during the calibration procedure.

Although the present invention has been described with particular specificity and illustrated to show a preferred embodiment, it should be understood that alternative embodiments are also within its scope.

We claim:

1. A method for operating a throttle control system, comprising the steps of:

providing a manually operated throttle controller;

providing a sensor connected to said manually operated throttle controller and having an output which is representative of the position of said manually operated throttle controller;

providing a microprocessor connected in signal communication with said sensor and having an input connected in signal communication with said output;

receiving a first position indicating signal from said sensor which is representative of a first known position of said manually operated throttle controller;

receiving a second position indicating signal from said sensor which is representative of a second known position of said manually operated throttle controller;

storing said first and second position indicating signals;

receiving a subsequent position indicating signal from said sensor which is representative of a subsequent position of said manually operated throttle controller; and calculating said subsequent position of said manually operated throttle controller as a function of said subsequent position indicating signal and said first and second position indicating signals.

2. The method of claim 1, wherein:

said first position indicating signal comprises a first set of magnitudes of three signals; and said second position indicating signal comprises a second set of magnitudes of said three signals.

3. The method of claim 2, wherein:

said three signals are generally redundant to each other.

4. The method of claim 1, further comprising:

receiving a third position indicating signal from said sensor which is representative of a third known position of said manually operated throttle controller; and receiving a fourth position indicating signal from said sensor which is representative of a fourth known position of said manually operated throttle controller.

5. The method of claim 1, wherein:

said first known position is generally equivalent to said manually operated throttle controller being in a maximum position at one end of the range of travel of said manually operated throttle controller.

6. The method of claim 5, wherein:

said one end of the range of travel of said manually operated throttle controller is in a reverse gear position.

7. The method of claim 5, wherein:

said second known position is generally equivalent to said manually operated throttle controller being in an intermediate position within said range of travel of said manually operated throttle controller.

8. The method of claim 7, wherein:

said intermediate position is a position at which a gear change, between neutral and either forward or reverse gears, is indicated.

9. The method of claim 1, wherein:

said calculating step comprises the steps of determining the total range between said first and second position indicating signals, calculating the mathematical difference between said first and subsequent position indicating signals, determining a ratio of said mathematical difference to said total range, and using said ration as an indicator of percentage of full throttle indicated by said subsequent position indicating signal.

10. A method for operating a throttle control system, comprising the steps of:

providing a manually operated throttle controller;

providing a sensor connected to said manually operated throttle controller and having an output which is representative of the position of said manually operated throttle controller;

providing a microprocessor connected in signal communication with said sensor and having an input connected in signal communication with said output;

receiving a first position indicating signal from said sensor which is representative of a first known position of said manually operated throttle controller;

receiving a second position indicating signal from said sensor which is representative of a second known position of said manually operated throttle controller;

receiving a third position indicating signal from said sensor which is representative of a third known position of said manually operated throttle controller;

receiving a fourth position indicating signal from said sensor which is representative of a fourth known position of said manually operated throttle controller;

storing said first, second, third, and fourth position indicating signals;

receiving a subsequent position indicating signal from said sensor which is representative of a subsequent position of said manually operated throttle controller; and calculating said subsequent position of said manually operated throttle controller as a function of said subsequent position indicating signal and two signal magnitudes selected from the group consisting of said first, second, third, and fourth position indicating signals.

11. The method of claim 10, wherein:

said first, second, third, and fourth position indicating signals each comprise a set of magnitudes of three signals.

12. The method of claim 11, wherein:

said three signals are generally redundant to each other.

13. The method of claim 12, further comprising:

receiving a fifth position indicating signal from said sensor which is representative of a fifth known position of said manually operated throttle controller.

14. The method of claim 12, wherein:

said first known position is generally equivalent to said manually operated throttle controller being in a maximum position at one end of the range of travel of said manually operated throttle controller.

15. The method of claim 14, wherein:

said one end of the range of travel of said manually operated throttle controller is in a reverse gear position.

16. The method of claim 15, wherein:

said second known position is generally equivalent to said manually operated throttle controller being in an intermediate position within said range of travel of said manually operated throttle controller; and said intermediate position is a position at which a gear change, between neutral and either forward or reverse gears, is indicated.

17. The method of claim 16, wherein:

said calculating step comprises the steps of determining the total range between said first and second position indicating signals, calculating the mathematical difference between said first and subsequent position indicating signals, determining a ratio of said mathematical difference to said total range, and using said ration as an indicator of percentage of full throttle indicated by said subsequent position indicating signal.

18. A method for operating a throttle control system, comprising the steps of:

providing a manually operated throttle controller;

providing a sensor connected to said manually operated throttle controller and having an output which is representative of the position of said manually operated throttle controller;

providing a microprocessor connected in signal communication with said sensor and having an input connected in signal communication with said output;

sequentially receiving a first, second, third, fourth, and fifth position indicating signals from said sensor which are representative of first, second, third, fourth, and fifth known positions, respectively, of said manually operated throttle controller;

storing said first, second, third, fourth, and fifth position indicating signals;

receiving a subsequent position indicating signal from said sensor which is representative of a subsequent position of said manually operated throttle controller; and calculating said subsequent position of said manually operated throttle controller as a function of said subsequent position indicating signal and two signal magnitudes selected from the group consisting of said first, second, third, fourth, and fifth position indicating signals.

19. The method of claim 18, wherein:

said first, second, third, and fourth position indicating signals each comprise a set of magnitudes of three signals which are generally redundant to each other.

20. The method of claim 19, wherein:

said calculating step comprises the steps of determining the total range between two signal magnitudes selected from the group consisting of said first, second, third, fourth, and fifth position indicating signals, calculating the mathematical difference between a selected one of said two signal magnitudes and said subsequent position indicating signal, determining a ratio of said mathematical difference to said total range, and using said ration as an indicator of percentage of full throttle indicated by said subsequent position indicating signal.

* * * * *